US006396443B1

(12) United States Patent
Conklin et al.

(10) Patent No.: US 6,396,443 B1
(45) Date of Patent: May 28, 2002

(54) INTEGRATED FLAT ANTENNA AND RADIO FREQUENCY UNIT FOR POINT-TO-POINT MICROWAVE RADIOS

(75) Inventors: Kenneth F. Conklin, Hermosa Beach; David B. Giguere, Palos Verdes Estates; James C. Chen, Torrance, all of CA (US)

(73) Assignee: Raytheon Company, Lexington, MA (US)

( * ) Notice: Subject to any disclaimer, the term of this patent is extended or adjusted under 35 U.S.C. 154(b) by 832 days.

(21) Appl. No.: 08/665,755

(22) Filed: Jun. 18, 1996

(51) Int. Cl.[7] ..... H01Q 1/24
(52) U.S. Cl. ..... 343/702; 343/891
(58) Field of Search ..... 343/700 MS, 853, 343/844, 890, 891; H01Q 21/00

(56) References Cited

U.S. PATENT DOCUMENTS

| | | | | |
|---|---|---|---|---|
| 4,876,709 A | | 10/1989 | Rogers et al. | 379/61 |
| 5,160,936 A | * | 11/1992 | Braun et al. | 343/700 MS |
| 5,206,655 A | * | 4/1993 | Caille et al. | 343/700 MS |
| 5,266,961 A | | 11/1993 | Milroy | 343/772 |
| 5,400,039 A | | 3/1995 | Araki et al. | 343/700 MS |

FOREIGN PATENT DOCUMENTS

| | | |
|---|---|---|
| DE | 4128972 A | 4/1993 |
| EP | 0570325 A | 11/1993 |
| EP | 0626764 | 11/1994 |
| WO | WO9525387 A | 9/1995 |

OTHER PUBLICATIONS

Strategies Unlimited, "RF Components for PCS Base Stations and Links, 1995–2000", Chapter 8.2, Radio Design and Manufacturing, pp. 221–225, Feb. 1996.

* cited by examiner

*Primary Examiner*—Michael C. Wimer
(74) *Attorney, Agent, or Firm*—Leonard A. Alkov; Glenn H. Lenzen, Jr.

(57) ABSTRACT

A point-to-point radio frequency unit/antenna has a flat antenna, preferably a continuous transverse stub antenna, integrated into the housing of the microwave unit. The radio frequency unit/antenna includes a housing having an exterior wall, a microwave radio frequency transceiver electronics package within the housing and having an antenna connection, and a flat antenna affixed to one face of the exterior wall of the housing. A microwave radio frequency feed communicates between the flat antenna and the antenna connection of the microwave transceiver electronics package. There is preferably a bracket structure on another face of the housing to affix the housing to a support.

20 Claims, 4 Drawing Sheets

INTEGRATED FLAT ANTENNA AND RADIO FREQUENCY UNIT FOR POINT-TO-POINT MICROWAVE RADIOS

BACKGROUND OF THE INVENTION

This invention relates to microwave radios, and, more particularly, to a radio frequency unit for a microwave radio.

Microwave radio communications are widely used to transfer large amounts of data, such as in earth and space microwave long-distance communications links. They are also of interest for shorter-range, lower-power applications such as the basic voice, video, and data links between, for example, a cellular base station and the central telephone office. In such applications, the microwave transmission distance is typically between about 0.5–5 miles, the microwave signal may be a specific frequency between about 2–94 GHz, and the power output of the microwave transmitter is about 100 milliwatts. Such microwave communications system are generally termed "point-to-point" systems.

Corresponding to the high-power microwave communications systems, a conventional point-to-point system has three basic physical parts: a signal processing unit (SPU), sometimes termed an "indoor" unit having the baseband radio components, a radio frequency (RF) unit (RFU), sometimes termed an "outdoor" unit having the microwave frequency radio components, and an antenna. Because a microwave feed is required between the components operating at microwave frequency, the radio frequency unit is located within a few feet of the antenna, which ordinarily is mounted outside and aimed at another point-to-point terminal located some distance away. The antenna is typically a parabolic antenna of the cassegrain type. The signal processing unit may be located quite some distance from the radio frequency unit. An ordinary cable set extends between the signal processing unit and the radio frequency unit, but a microwave coaxial feed is required between the radio frequency unit and the antenna.

As point-to-point systems become more popular, their physical packaging becomes more important. The existing radio frequency units and antennas are bulky and, in many cases, difficult to mount, align, and maintain in alignment. With the proliferation of point-to-point systems in large cities, new mounting space on existing masts and elsewhere has become more difficult to find. Installers must hoist the subsequently installed radio frequency unit and antenna to ever-more-precarious locations in order to establish line-of-sight contact with the remote terminal. Conventional point-to-point radio frequency units and antennas may be obtrusive and unsightly, particularly when large numbers of them are concentrated in the available space.

There is a need for an improved radio frequency unit and antenna which overcomes these problems. The present invention fulfills this need, and further provides related advantages.

SUMMARY OF THE INVENTION

The present invention provides an integrated point-to-point microwave radio frequency unit/antenna. The integrated radio frequency unit/antenna is compact and lighter than existing units, easily handled and mounted, and readily aligned and maintained in alignment. It can be mounted in locations which would not be practical for conventional microwave radio frequency units and antennas, such as windows of office buildings. The installer need be concerned with only a single box, not two separate components with a microwave cable extending between them, as is the case for some existing systems. The flat-plate, integrated radio frequency unit/antenna is consequently much less visually obtrusive than conventional systems using a parabolic dish antenna.

In accordance with the invention, an integrated point-to-point microwave radio frequency unit/antenna comprises a housing having an exterior wall, a microwave radio frequency transceiver electronics package within the housing and having an antenna connection, a flat antenna integral with the exterior wall of the housing, and a microwave radio frequency feed communicating between the flat antenna and the antenna connection of the microwave transceiver electronics package. There is desirably a means such as a bracket structure built into another wall of the housing to affix the housing to a support structure.

The flat antenna is preferably a continuous transverse stub antenna that is rectangular in shape and relatively thin. It may built into the side of the housing as part of the wall, or more preferably, built as a separate unit and attached integrally to the wall of the housing. The required size of the antenna is dependent upon the frequency at which it is used. For example, such a flat antenna with 38 dB of gain when used for transceiving at 38 GHz is typically 10-½ inches by 10-½ inches in transverse extent, the square antenna being a special case of the rectangular antenna, and about 1 inch thick. The housing, including all of the electronics package, is typically about 12 inches by 12 inches in transverse dimensions, and about 3 inches thick. The entire radio frequency unit/antenna is thus no larger than a small cosmetics case. It is easily handled, mounted, and aimed. By contrast, a conventional radio frequency unit itself has a size of about 12 inches by 12 inches by 12 inches, and the associated parabolic antenna has a diameter of 12–24 inches.

The approach of the invention also offers electronic features not possible with a conventional approach. The microwave feed between the electronics package and the antenna is on the order of at most a few inches and is inside the housing, reducing the possibility of damage or interference. The preferred continuous transverse stub flat antenna may be electronically aimed to achieve fine adjustment of the alignment and to maintain alignment when mounting conditions change, such as when a mounting mast sways or a building deforms due to thermal effects during the course of a day.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
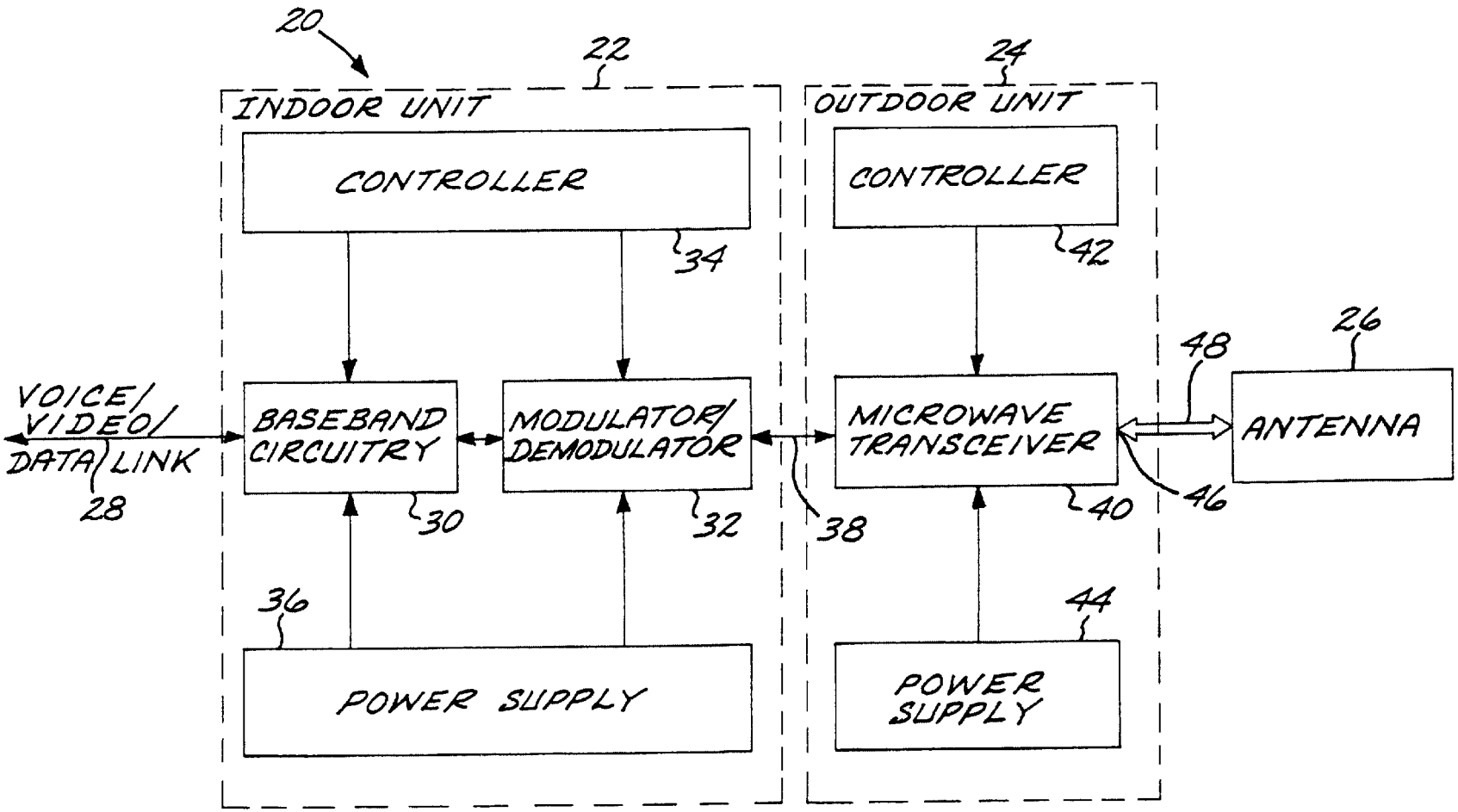
FIG. 1 is a schematic diagram of a microwave radio transmitter and receiver.

FIG. 1 is a schematic diagram of a microwave radio transceiver system 20. The general electronic structure of such systems 20 is known in the art and is described in greater detail, for example, in "RF Components for PCS Base Stations", published by Strategies Unlimited, 1996. The present invention resides not in a change to this basic, known electronic approach, but in its packaging and presentation in a highly advantageous form.

The system 20 includes a signal processing unit 22 that processes baseband signals, an radio frequency unit 24 that processes microwave signals, and a microwave antenna 26. The signal processing unit has as one input/output voice, video, and/or data link information 28. This information 28 is processed through a baseband circuitry 30 and a modulator/demodulator 32. A controller 34 and a power supply 36 are also provided. The signal processing unit 22 communicates with the radio frequency unit 24 at low frequencies through a conventional signal cable 38.

The radio frequency unit 24 includes a microwave transceiver 40 that operates in a selected microwave frequency band within the broad band extending from about 2 to about 94 GHz (Gigahertz) by converting the low-frequency signal of the signal processing unit 22. A controller 42 and a power supply 44 are provided. The microwave transceiver 40 has an antenna connection 46 into which a microwave radio frequency feed 48 is connected to provide a signal to the antenna 26, or to receive a signal from the antenna. The feed 48 may be a coaxial cable or waveguide which cannot be more than a few feet long without suffering substantial signal attenuation.

Figure 2:
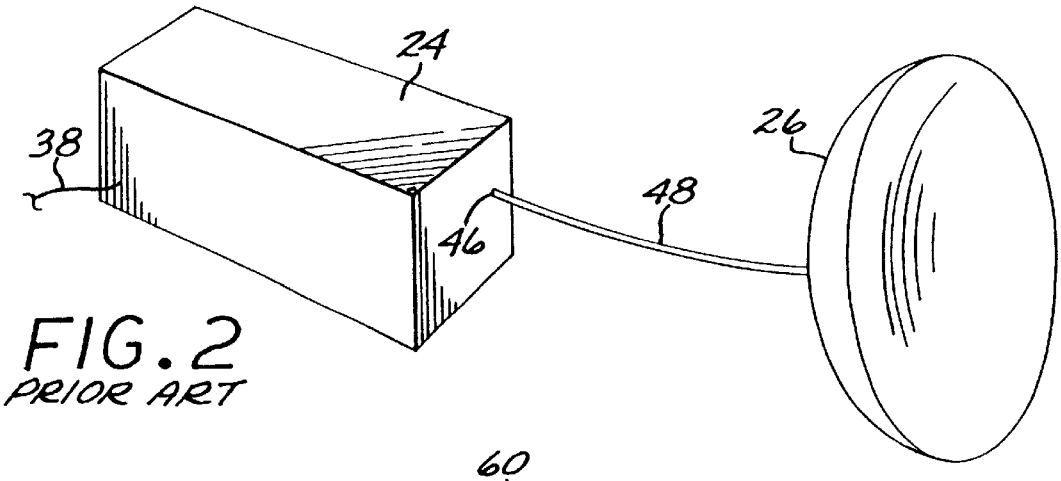
FIG. 2 PRIOR ART
FIG. 2 is a perspective view of a conventional microwave radio frequency unit and antenna.

FIG. 2 depicts the implementation of a conventional prior radio frequency unit 24 and antenna 26, connected by the microwave feed 48, which utilizes the electronics approach of FIG. 1. The radio frequency unit 24 typically has measurements of 12 inches by 12 inches by 12 inches and weighs about 35 pounds. The antenna 26 is a cassegrain parabolic antenna having a dish diameter of about 12 inches or more and a weight of about 15 pounds. Both components must be mounted at a location such that the antenna 26 may be aimed at a similar but remotely located terminal. The installer must find a way to mount the antenna 26 so that it is aligned with the antenna of the remote unit, and to mount the radio frequency unit 24 so that it is secure yet is within the range permitted by the length of the microwave feed 48. Other versions of the prior approach of FIG. 2 are known wherein the parabolic antenna is affixed directly to the radio frequency unit, but such a combined approach remains awkward to handle and heavy.

Figure 3:
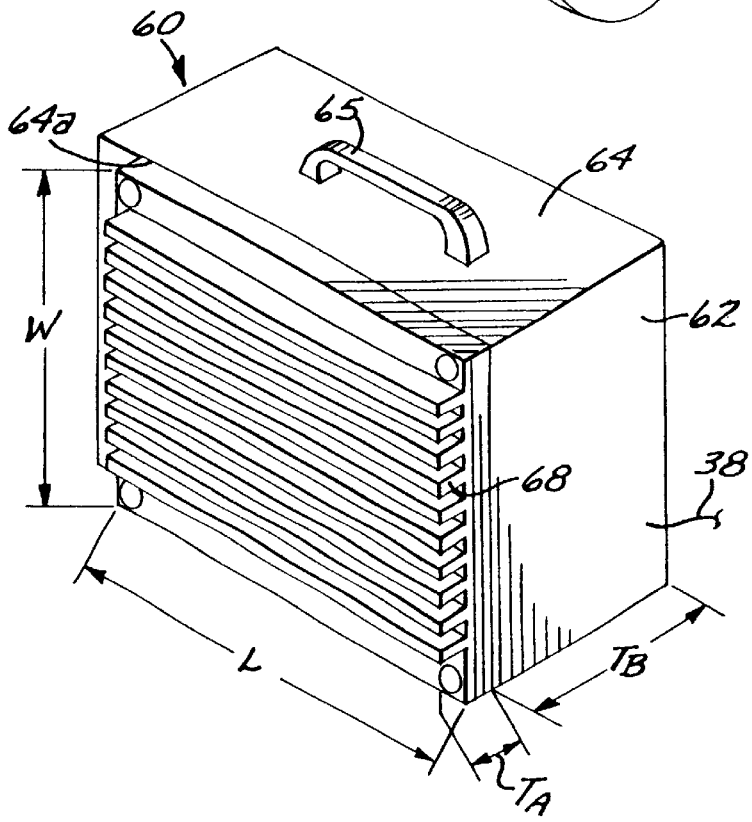
FIG. 3 is a perspective view of an integrated radio frequency unit/antenna according to the invention.
Figure 4:
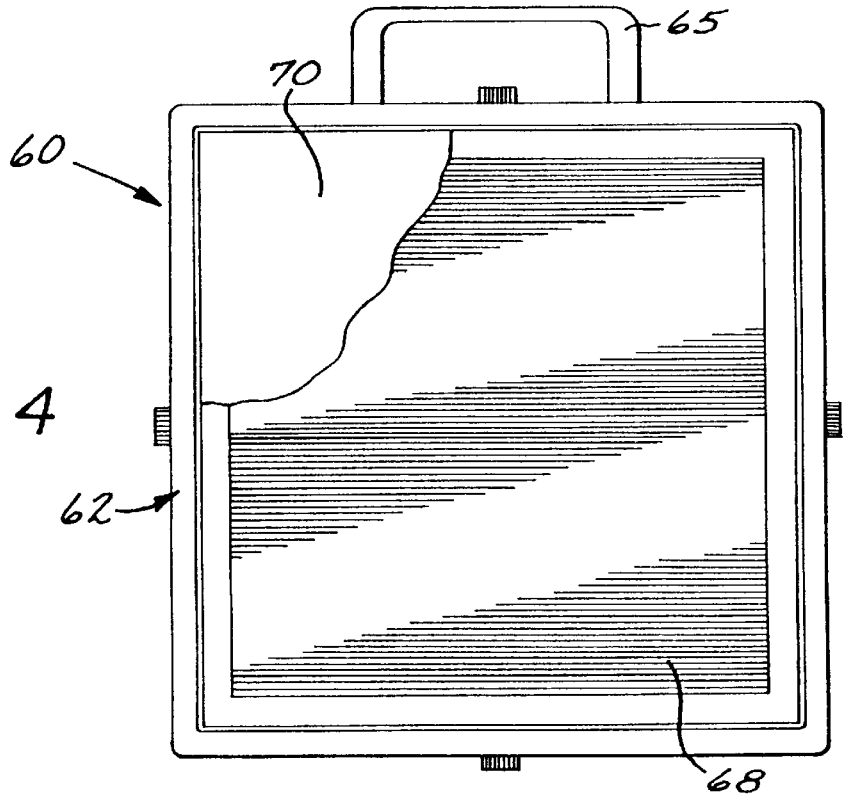
FIG. 4 is a partially sectioned front elevational view of an preferred integrated radio frequency unit/antenna according to the invention.
Figure 5:
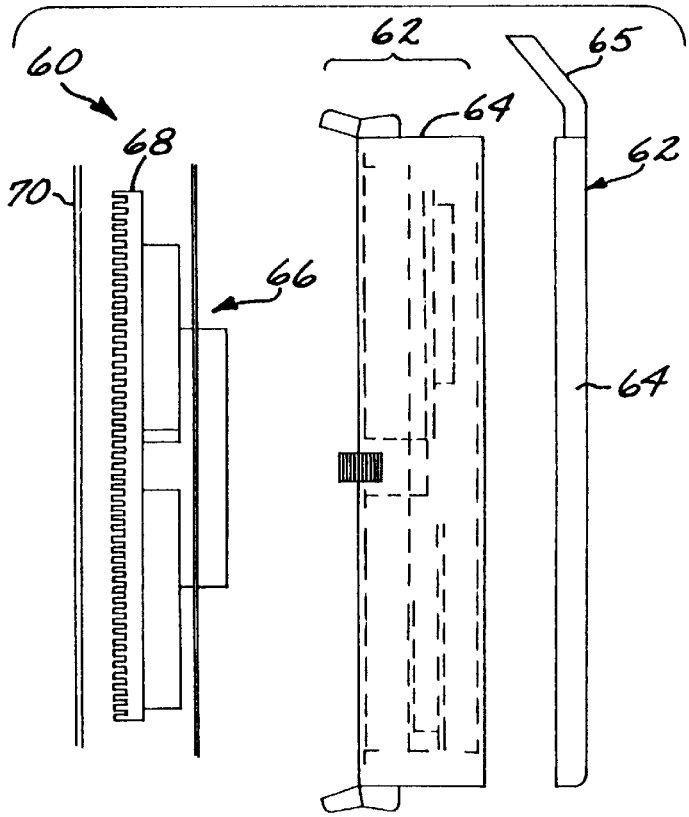
FIG. 5 is an exploded side elevational view of the integrated radio frequency unit/antenna of FIG. 4, illustrating a typical layout of components.

FIG. 3 shows an integrated radio frequency unit/antenna in perspective view. FIG. 4 illustrates a preferred form of the present invention in partially sectioned front elevational exterior view, and FIG. 5 is an exploded side view of the preferred apparatus. This apparatus uses the general electronics approach of FIG. 1, but with a different architecture and antenna that offers important advantages. An integrated radio frequency unit/antenna 60 includes a housing 62 having an exterior wall 64. A handle 65 extending from the housing 62 permits the radio frequency unit/antenna 60 to be easily carried. A microwave radio frequency transceiver electronics package 66 is fixed in the housing 62. The electronics package 66 includes the microwave transceiver 40, the controller 42, and the power supply 44. Part of the exterior wall 64 is formed as an integral flat antenna 68. The flat antenna 68 may be formed separately and attached to the wall 64, as illustrated, or it may be formed as part of the wall itself. That portion of the wall 64 which is not the antenna 68 may be made of any operable material, such as a metal or a plastic. A radome 70 in the form of a plastic sheet is mounted over the face of the flat antenna 68 to protect it.

The flat antenna 68 is preferably a continuous transverse stub (CTS) antenna. The CTS microwave antenna is known in the art and is described, for example, in U.S. Pat. No. 5,266,961, whose disclosure is incorporated by reference. In general terms, and as illustrated in FIGS. 3 and 5, the CTS antenna has a dielectric element with a first portion and a second portion extending generally transversely to the first portion. The second portion forms a transverse stub that protrudes from a first surface of the first portion. A first conductive element is disposed coextensively with the dielectric element along a second surface of the first portion. A second conductive element is disposed along the first surface of the dielectric element and is along transversely extending edgewalls formed by the second portion of the dielectric element. Further details of construction are disclosed in the '961 patent.

The CTS antenna has particular advantages when used in the present application. The CTS antenna is planar, small in lateral dimensions and thickness, and light in weight. The output signal of the CTS antenna may be steered slightly electronically. During mounting, the radio frequency unit/antenna 60 must be aligned generally toward the remote unit with which communication is established. However, that alignnent may be slightly disrupted due to weather or temperature effects on the mounting structure. In that case, the small deviation from proper alignment may be compensated for electronically to maintain a high signal strength aimed at the remote unit.

The integrated radio frequency unit/antenna 60 has an antenna connection 46 and a microwave radio frequency feed cable 48 extending from the antenna connection 46 to the back side of the flat antenna 68. However, that radio frequency feed 48 is at most 1–2 inches long and contained entirely within the housing 62. There is very little microwave attenuation as the signal passes through this short feed 48. The installer is only required to position and fix in place the single integrated radio frequency unit/antenna 60, and is not concerned with moving and positioning two units in a compatible manner.

The inventors have developed a prototype design for the integrated radio frequency unit/antenna 60, shown in FIGS. 4–5, for operation at a microwave frequency of 37–40 GHz. The flat antenna has a width W of about 10-½ inches, a length L of about 10-½ inches, and a thickness $T_A$ of about 1 inch. The remaining components, the microwave transceiver 40, controller 42, and power supply 44 fit into a housing having the same length and width, and a thickness $T_B$ of about 2 inches. The total size of the housing and antenna package is about 12 inches by 12 inches by 3 inches. The weight of the integrated radio frequency unit/antenna 60 is about 10 pounds.

Figure 6:
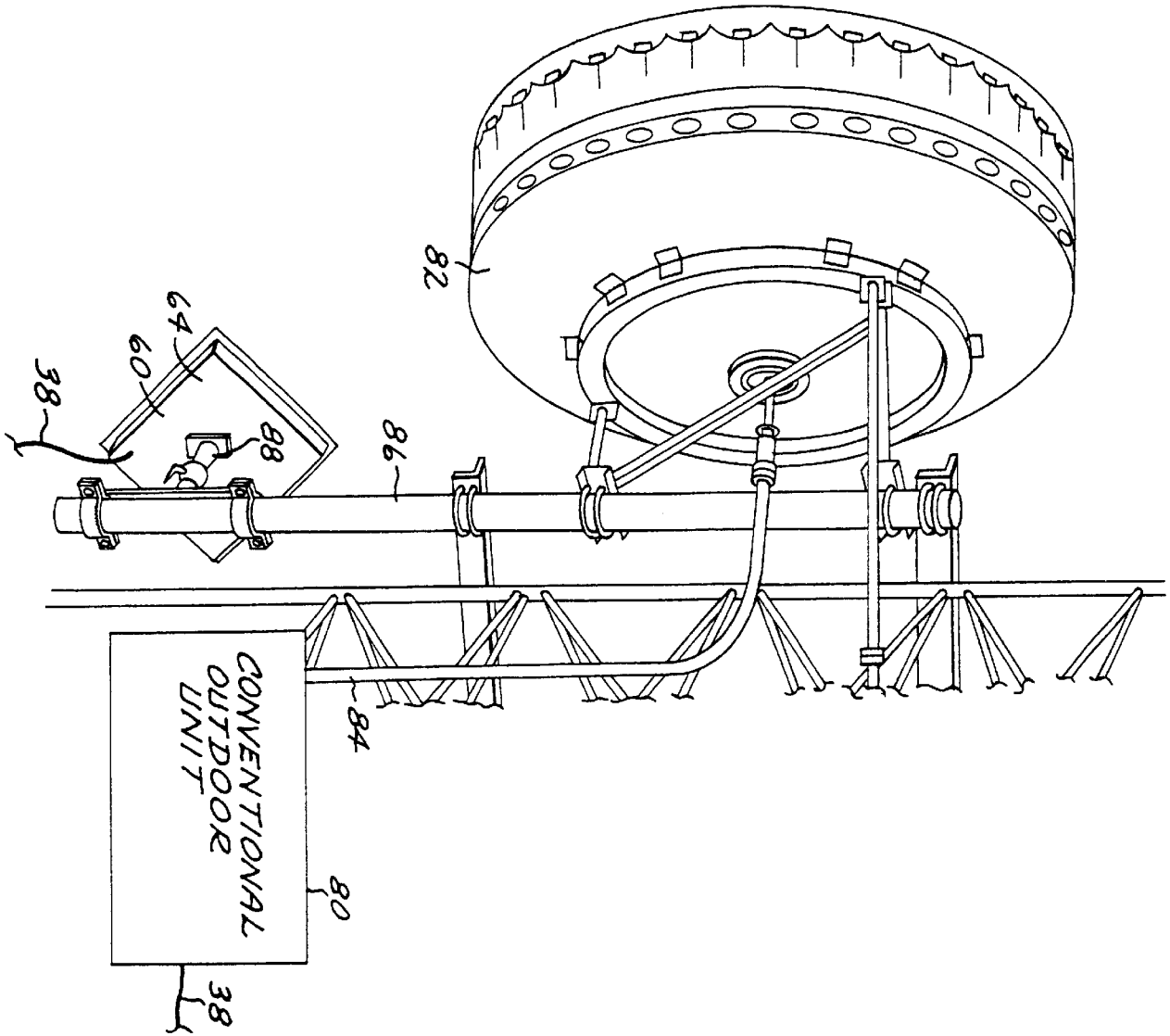
FIG. 6 is a schematic perspective view of a conventional radio frequency unit and antenna and an integrated radio frequency unit/antenna mounted to a mast.

FIG. 6, which is schematic and not drawn to scale, illustrates the mounting of a conventional radio frequency unit 80 and its antenna 82, connected by their microwave feed 84, on a mast 86. Also shown is an integrated radio frequency unit/antenna 60 of the invention. The integrated radio frequency unit/antenna 60 has a mounting bracket 88 attached to one of the exterior walls 64 other than the one to which the integrated flat antenna 68 is attached, and the mounting bracket permits straightforward adjustable attachment to the mast 86. It is apparent that the approach of the invention is much more convenient for installation and alignment than the conventional approach. The integrated radio frequency unit/antenna 60 can also be mounted in locations and places which are largely not usable with the conventional device. For example, the integrated radio frequency unit/antenna 60 is readily mounted to a window frame in much the same manner as a room air conditioner.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An integrated point-to-point microwave radio frequency unit/antenna, comprising:

a housing having an exterior wall;

a microwave radio frequency transceiver electronics package within the housing, the microwave radio frequency transceiver electronics package comprising a baseband signal processing unit having an input/output, and being operable to process information selected from the group consisting of voice, video, and data link information, a microwave transceiver having a low-frequency side with a baseband signal connection to the baseband signal processing unit and a high frequency side including an antenna connection;

a flat antenna integral with the exterior wall of the housing; and a microwave radio frequency feed communicating between the flat antenna and the antenna connection of the microwave transceiver electronics package.

2. The radio frequency unit/antenna of claim 1, wherein the electronics package comprises a radio frequency antenna coupler in communication with the high-frequency side of the microwave transceiver and including the antenna connection;

a controller for the transceiver; and a power supply for the transceiver and the controller.

3. The radio frequency unit/antenna of claim 1, wherein the flat antenna is a continuous transverse stub antenna.

4. The radio frequency unit/antenna of claim 1, wherein the flat antenna forms a part of the exterior wall.

5. The radio frequency unit/antenna of claim 1, wherein the flat antenna is affixed to the exterior wall.

6. The radio frequency unit/antenna of claim 1, wherein the radio frequency feed is a coaxial cable.

7. The radio frequency unit/antenna of claim 1, further including means for affixing the housing to a support.

8. The radio frequency unit/antenna of claim 3, wherein the continuous stub antenna is rectangular in shape.

9. The radio frequency unit/antenna of claim 8, wherein the continuous stub antenna has rectangular dimensions of about 10-½ inches wide by 10-½ inches long.

10. The radio frequency unit/antenna of claim 1, wherein the antenna connection of the electronics package has an input/output frequency of from about 2 GHz to about 94 GHz.

11. The radio frequency unit/antenna of claim 1, wherein the antenna connection of the electronics package has an input/output frequency of from about 37 GHz to about 40 GHz.

12. An integrated point-to-point microwave radio frequency unit/antenna, comprising:

a housing having an exterior wall;

a microwave radio frequency transceiver electronics package within the housing and having an antenna connection, the microwave radio frequency transceiver electronics package comprising a signal processing unit operable to process signals selected from the group consisting of voice, video, and data signals, and a microwave transceiver in communication with the signal processing unit and the antenna connection;

a flat antenna affixed to the exterior wall of the housing;

a microwave radio frequency feed communicating between the flat antenna and the antenna connection of the microwave transceiver electronics package; and means for affixing the housing to a support.

13. The radio frequency unit/antenna of claim 8, wherein the electronics package comprises the microwave transceiver having a low-frequency side with a baseband signal connection and a high-frequency side;

a radio frequency antenna coupler in communication with the high-frequency side of the transceiver and including the antenna connection;

a controller for the transceiver; and a power supply for the transceiver and the controller.

14. The radio frequency unit/antenna of claim 12, wherein the radio frequency feed is a coaxial cable.

15. The radio frequency unit/antenna of claim 12, wherein the flat antenna is a continuous transverse stub antenna.

16. The radio frequency unit/antenna of claim 15, wherein the continuous transverse stub antenna is rectangular in shape.

17. The radio frequency unit/antenna of claim 16, wherein the continuous stub antenna has rectangular dimensions of about 10-½ inches wide by 10-½ inches long.

18. The radio frequency unit/antenna of claim 12, wherein the antenna connection of the electronics package has an input/output frequency of from about 2 GHz to about 94 GHz.

19. The radio frequency unit/antenna of claim 12, wherein the antenna connection of the electronics package has an input/output frequency of from about 37 GHz to about 40 GHz.

20. An integrated point-to-point microwave radio frequency unit/antenna, comprising:

a housing having an exterior wall and a handle by which the housing may be carried;

a microwave radio frequency transceiver electronics package within the housing and having an antenna connection, wherein the antenna connection of the electronics package has an input/output frequency of from about 37 GHz to about 40 GHz;

a flat continuous transverse stub antenna affixed to the exterior wall of the housing;

a microwave radio frequency feed communicating between the flat antenna and the antenna connection of the microwave transceiver electronics package; and means for affixing the housing to a support.

* * * * *